United States Patent [19]

Citterio

[11] Patent Number: 4,801,052

[45] Date of Patent: Jan. 31, 1989

[54] METERING CONTAINER FOR THICK AND SEMI-THICK COSMETIC PRODUCTS, SUCH AS CREAMS AND THE LIKE

[76] Inventor: Gianfranco Citterio, Via Stoppani 1/3 22058, Osnago (Como), Italy

[21] Appl. No.: 63,250

[22] Filed: Jun. 17, 1987

[30] Foreign Application Priority Data

Jun. 19, 1986 [IT] Italy ..... 20855 A/86

[51] Int. Cl.[4] ..... B67D 5/42

[52] U.S. Cl. ..... 222/386; 401/76

[58] Field of Search ..... 222/386, 370, 392, 326, 222/327; 401/68, 75, 76, 175, 171, 172

[56] References Cited

U.S. PATENT DOCUMENTS

| | | | |
|---|---|---|---|
| 3,082,914 | 3/1963 | Gill | 222/390 |
| 4,505,606 | 3/1985 | Lockwood | 401/75 |
| 4,702,399 | 10/1987 | Davis | 222/390 |

*Primary Examiner*—Joseph J. Rolla
*Assistant Examiner*—Kenneth Noland
*Attorney, Agent, or Firm*—Bucknam and Archer

[57] ABSTRACT

The present invention relates to a metering container, particularly designed for thick and semi-thick cosmetic products, such as creams and the like, comprising a holding body including, at the top, a delivery surface and, in its inside, a chamber holding the product to be delivered, which is closed at the bottom by a sliding member which may be displaced with respect to an axial stem extending in the inside of the body and rigid with an outer ring nut. The main feature of the invention is that the container comprises for displacing the sliding member, as the stem is rotated, consisting of an intermediate body rigid with the sliding member and formal with toothed portions, abutting on the surface of the stem, which is smooth and substantially shaped as a cylindrical helix.

1 Claim, 3 Drawing Sheets

METERING CONTAINER FOR THICK AND SEMI-THICK COSMETIC PRODUCTS, SUCH AS CREAMS AND THE LIKE

BACKGROUND OF THE INVENTION

The present invention relates to a metering container, specifically designed for thick and semi-thick cosmetic products, such as creams and the like.

As is known, cosmetic cream containers are presently commerically available which substantially consist of a holding casing, of elongated cylindrical shape which is provided, in its inside, with a chamber holding the cream to be delivered which chamber is closed at the bottom by a sliding member including, at its middle portion, a nut screw rotatably engaged with an axial stem provided with a corresponding thread.

Since the sliding member is not able of rotating about the stem, as the stem is rotated a corresponding displacement of the sliding member will occur, which by practically acting as a plunger causes the cream to be delivered or metered out.

Such a construction has tightness drawbacks of the nut screw and threaded stem, since it is not possible to provide a tight coupling at the thread region; thus the cosmetic cream may leak at the coupling region.

SUMMARY OF THE INVENTION

Thus, the main object of the present invention is to overcome the above mentioned drawback, by providing a metering container assuring a perfect tightness of the mutually sliding portions.

Another object of the present invention is to provide a metering container which affords the possibility of varying the volume of the cream holding chamber so as to deliver different cream doses.

Another object of the present invention is to provide such a metering container which is highly reliable in operation.

Yet another object of the present invention is to provide a cosmetic product metering container which is of simple construction and reduced cost.

According to one aspect of the present invention, the above objects, as well as yet other objects which will become more apparent hereinafter, are achieved by a metering container, particularly designed for thick and semi-thick cosmetic products, such as creams and the like, comprising a holding product including, at the top, a delivering surface and, in its inside, a chamber for holding the products to be delivered, which is closed at the bottom by a sliding member which may be displaced with respect to an axial stem extending in the inside of the body and rigid with an outer ring nut.

The metering container is moreover characterized in that it comprises means for displacing said sliding member, as the stem is rotated, consisting of a middle body, rigid with the sliding member and having toothed portions abutting on the surface of said stem and substantially shaped as a portion of a cylindrical helix.

BRIEF DESCRIPTION OF THE DRAWINGS

Further characteristics and advantages of the invention will become more apparent hereinafter from the following detailed description of a preferred embodiment of a metering container specifically designed for holding thick and semi-thick cosmetic products, such as creams and the like, which is illustrated, by way of a not limitative example, with reference to the accompanying drawings, where.

DESCRIPTION OF THE PREFERRED EMBODIMENTS

Figure 1:
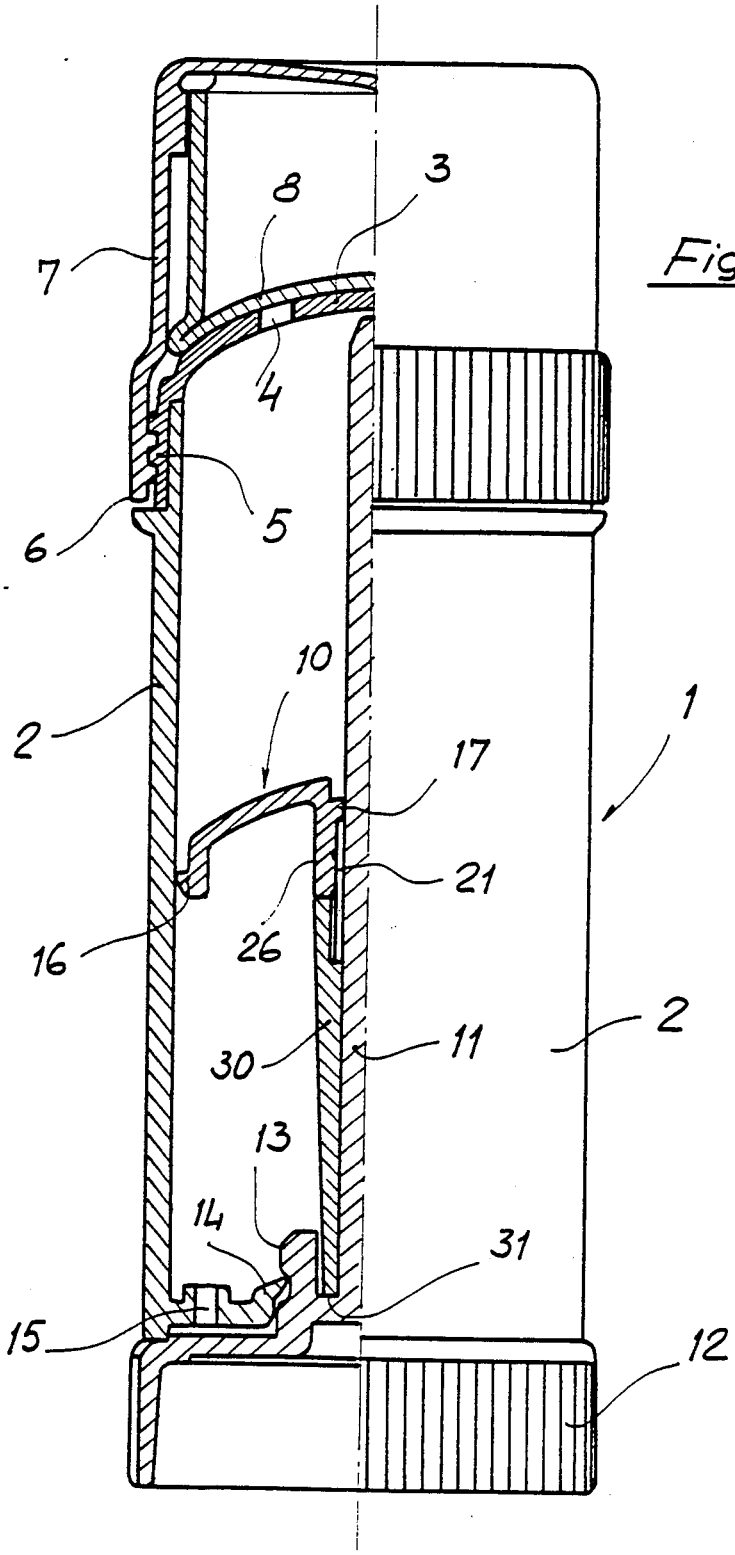
FIG. 1 represents a cross sectional view of the metering container according to the invention, taken along a diametrical plane.
Figure 2:
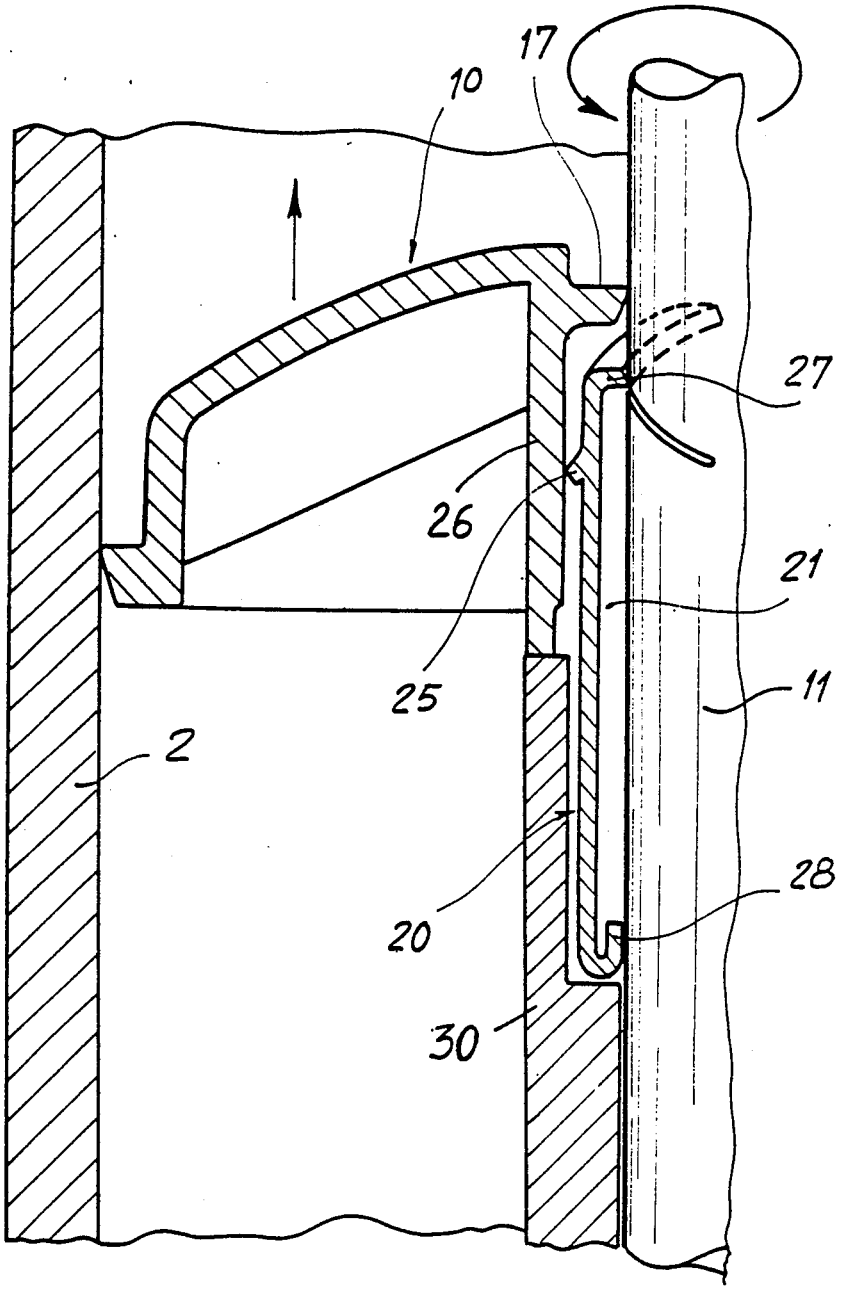
FIG. 2 illustrates, on an enlarged scale, the detail of the sliding member and intermediate body.
Figure 3:
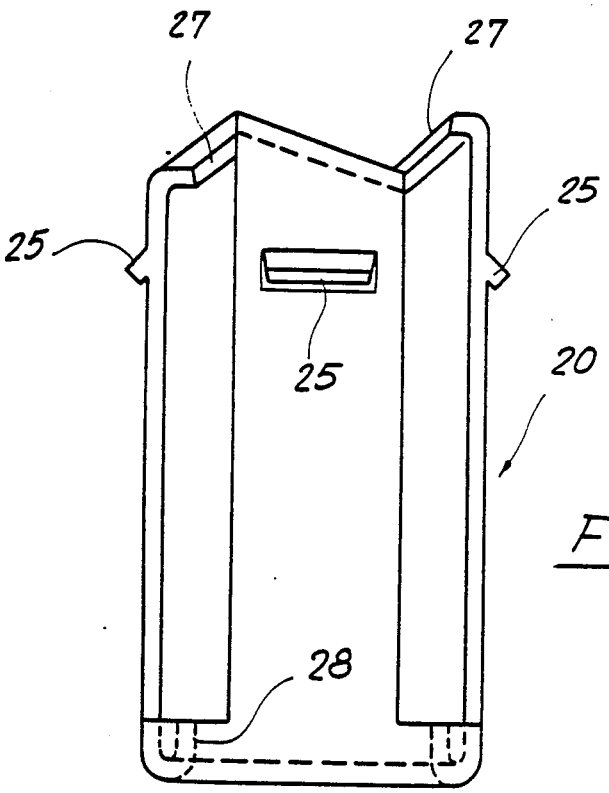
FIG. 3 ilustrates an elevation view of the intermediate body.
Figure 4:
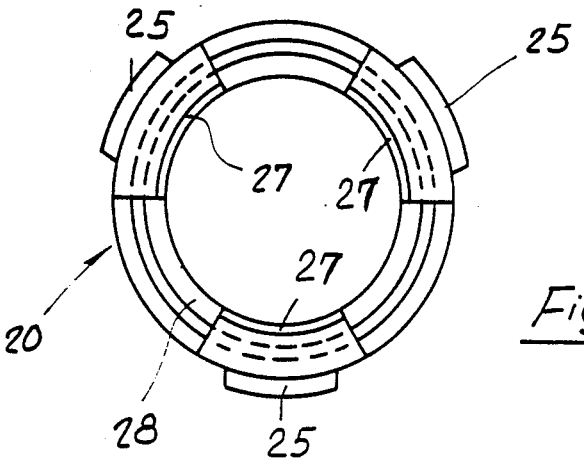
FIG. 4 is a top view of the intermediate body.

With reference to the figures of the accompanying drawings, the metering container, specifically designed for thick and semi-thick cosmetic products, such as creams and the like, which is indicated overally at the reference number 1, comprises a holding body, preferably of elongated cylindrical shape, which is provided, at the top thereof, with a metering or delivering surface 3, provided with cream delivery holes, indicated at the reference number 4.

The delivery surface 3 is formed on a cup member, applied to the holding body 2 and provided with an outer thread 5, therewith engages the inner thread 6 of a cover member or closure plug 7 which is provided, as is conventional, with an undercup member 8 coupled, in the closure position, to the delivery surface 3.

Inside the holding body 2 there is provided a sliding member, indicated overally at the reference number 10, which is prevented from rotating with respect to the holding body 2 and which may slide, with respect to an axial stem 11 extending inside said body 2 and which is coupled to an operating ring nut 12 accessible at the outer bottom portion of the body 2.

At the stem 11 attaching region, the ring nut 12 is provided with a collar 13 engaging on a crown member 14 arranged at the bottom of the holding body 2 and provided with a plurality of air holes.

The mentioned sliding member 10 is provided, on the periphery thereof, with a lip member 16 tightly engaging with the inner surface of the holding body 2 and, at its central portion, it is provided with a ring gear 17 tightly engaging with the stem 11, which is smooth.

The main feature of the present invention is that the means for displacing the sliding member, as the stem 11 is rotated, consist of an intermediate body 20, housed in a small recess 21 arranged at a central cut off of the sliding member 10, between the sliding member 10 and the stem 11.

The intermediate body 20 which, preferably, is made of a metal material and is of annular shape, is provided, on its side surface, with small wings 25 made for example by shearing which insert into the central portion 26 of the sliding member 10, so as to render said sliding member able of rigidly sliding with the intermediate body 20 as the stem 11 rotates.

At its top axial end, the intermediate body 20 is provided with toothed portions 27 which abut against the plastics material surface of the stem 11, so as to provide an engagement which depends on the teeth 27 which are advantageously shaped as a cylindrical helix portion.

At its bottom end, the intermediate body 20 is provided with an upturned lip 28 which provides a further tightness action on the mentioned stem 11.

With the disclosed arrangement, the stem 11 is made with a smooth surface and, accordingly, the ring gear 17 will provide a perfect tightness between the sliding member 10 and stem 11, the displacement or translation movement of the sliding member 10 being obtained owing to the fact that, as the stem 11 is rotated, the teeth 27 will practically abut against the surface of the stem 11, which is a cylindrical helix; in fact, since the sliding member is not able of rotating, it will be axially displaced.

More specifically, the stem is made smooth and the thread, which affords the possibility of axially displacing the sliding member 10, is generated, during the rotation, by the teeth 27.

The intermediate body 20 is held in its position owing to the provision of a spacer member 30, which engages between the end of the end portion 26 and a recess 31, arranged between the stem 11 and said collar 13.

The length of the spacer member 30 may be modified according to requirements thereby providing the possibility of obtaining a useful starting volume of the chamber defined by the sliding member 10 inside the holding body which may be varied at will: thus, it will be possible to obtain different holding capabilities for the metering container with the same size of its component elements.

During the use, by rotating the ring nut 12, the stem 11 will be rotated and then the sliding member 10 will be axially displaced thereby delivering a metered dose of the cream or cosmetic product.

Moreover all of the leak problems are completely overcome, since the tightness of the sliding member, both with respect to the surface of the holding body and with respect to the stem 11, is made on smooth surfaces.

In addition, possible leaks susceptible to occur between the ring gear 17 and stem 11, are restrained by the provision of the upturned edge 28, which practically operates as a doctor blade, with respect to the stem 11.

From the above disclosure it should be apparent that the invention fully achieves the intended objects.

In particular the fact should be pointed out that the provision of an intermediate body 20, made of a metal material or other suitable material and able of cutting into the smooth surface of the stem 11, as it abuts thereon, affords that same useful effect which is presently obtained by means of a threaded stem engaging in a nut screw, while using an originally smooth stem, effective to provide an easy tightness.

Another important feature of the present invention is that, under the sliding member 10 a spacer member may be arranged, of preset length, for changing the starting useful volume of the chamber defined inside the holding body.

The invention, as disclosed, is susceptible to many modifications and variations, all of which will enter the scope of the invention itself.

Moreover all of the details may be replaced by other technically equivalent elements.

In practicing the invention, the used materials provided that they are compatible to the intended use, as well the specific shapes and size may be any, according to requirements.

I claim:

1. A metering container, specifically designed for thick and semi-thick cosmetic products, such as creams and the like, comprising a holding body provided, at the top, with a delivering surface and, in its inside, with a chamber holding the product to be delivered, which is closed at the bottom by a sliding member, which may be displaced with respect to an axial stem extending inside said holding body and rigid with an outer ring nut, an intermediate body rigidly coupled with said sliding member and having a toothed portion abutting and cutting on a smooth surface of said stem for axially displacing said sliding member as said stem is rotated, said sliding member being provided, on its periphery, with a tightness lip acting on the inner surface of the holding body and, at a central portion, with a ring gear tightly engaging with said stem, said intermediate body being housed in a narrow recess provided between the axial end portion of said sliding member and said stem, said intermediate body being provided, on its surface, with wing members which insert into the central portion of said sliding member, so as to render said intermediate body rigidly coupled with said sliding member.

* * * * *